US008006969B2

(12) United States Patent
Warmus

(10) Patent No.: US 8,006,969 B2
(45) Date of Patent: Aug. 30, 2011

(54) BOOK PRODUCTION APPARATUS

(75) Inventor: James L. Warmus, LaGrange, IL (US)

(73) Assignee: R.R. Donnelley, Chicago, IL (US)

( * ) Notice: Subject to any disclaimer, the term of this patent is extended or adjusted under 35 U.S.C. 154(b) by 0 days.

(21) Appl. No.: 12/948,290

(22) Filed: Nov. 17, 2010

(65) Prior Publication Data

US 2011/0112680 A1 May 12, 2011

Related U.S. Application Data

(62) Division of application No. 12/008,377, filed on Jan. 10, 2008, now Pat. No. 7,874,550.

(51) Int. Cl.
*B65H 5/00* (2006.01)
*B65H 39/00* (2006.01)

(52) U.S. Cl. ..... 270/52.03; 270/52.02; 270/52.16

(58) Field of Classification Search ..... 270/1.01, 270/1.02, 52.02, 52.03, 52.04, 52.05, 52.16
See application file for complete search history.

(56) References Cited

U.S. PATENT DOCUMENTS

| | | | |
|---|---|---|---|
| 3,608,888 | A | 9/1971 | McCain et al. |
| 3,899,165 | A | 8/1975 | Abram et al. |
| RE32,690 | E | 6/1988 | Wong |
| 4,768,766 | A | 9/1988 | Berger et al. |
| 5,011,123 | A | 4/1991 | Vigano |
| 5,029,830 | A | 7/1991 | Quadracci |
| 5,031,891 | A | 7/1991 | Kobler et al. |
| 5,100,116 | A | 3/1992 | Graushar |
| 5,114,128 | A | 5/1992 | Harris, Jr et al. |
| 5,143,362 | A | 9/1992 | Doane et al. |
| 5,144,562 | A | 9/1992 | Stikkelorum et al. |
| 6,167,326 | A | 12/2000 | Graushar et al. |
| 6,240,334 | B1 | 5/2001 | Duke et al. |
| 6,347,260 | B1 | 2/2002 | Graushar et al. |
| 6,445,975 | B1 | 9/2002 | Ramsey |
| 6,682,062 | B2 | 1/2004 | Graushar et al. |
| 2003/0112479 | A1 | 6/2003 | Huber et al. |
| 2004/0173958 | A1 | 9/2004 | Graushar |
| 2005/0098935 | A1 | 5/2005 | Sittinger et al. |

*Primary Examiner* — Leslie A Nicholson, III
(74) *Attorney, Agent, or Firm* — McCracken & Frank LLP

(57) ABSTRACT

A book product apparatus includes a gathering line and a plurality of feeding devices adapted to dispense at least one signature onto the gathering line. The apparatus further includes a controller operatively connected to the plurality of feeding devices for controlling the operation of the feeding devices, wherein a comparison of two customer data sources generates instructions for the feeding devices.

10 Claims, 5 Drawing Sheets

BOOK PRODUCTION APPARATUS

CROSS REFERENCE TO RELATED APPLICATIONS

This application is a divisional of application Ser. No. 12/008,377, which claims the benefit of U.S. Provisional Application Ser. No. 60/880,210 filed Jan. 11, 2007.

REFERENCE REGARDING FEDERALLY SPONSORED RESEARCH OR DEVELOPMENT

Not applicable

SEQUENTIAL LISTING

Not applicable

BACKGROUND

1. Field of the Invention

The present invention relates generally to an apparatus for producing books or other printed materials, and more specifically to an apparatus for creating customized books or other printed materials.

2. Description of the Background

Books and other printed materials typically comprise a series of signatures that have been bound together. Each signature consists of one or more printed pages, wherein the signatures are gathered on a gathering or binding line in a particular order, and are then stitched or glued together to form the book.

Saddle-stitch gathering lines are known and typically include a plurality of packer boxes or feeding devices positioned along a gathering conveyor in the form of a chain, wherein each packer box or a selected set of packer boxes delivers printed signatures in order onto chain spaces of the gathering conveyor. The gathered signatures are then bound, trimmed, bundled, and shipped using well known methods.

Using computer control systems, it is possible to customize a book or magazine in order to target a particular demographic group. This is typically accomplished by selectively enabling and disabling selected packer boxes along a binding line so that a signature designed to appeal to the targeted demographic group is inserted into the book at a designated location.

One known system selectively collates and binds signatures to produce different versions of a particular publication. A version code is associated with each recipient of a publication and is typically stored as part of the mailing list. A controller reads an address and a version code for a recipient and uses the version code to trigger only those packer boxes that contain signatures that are to be bound into a particular publication for that recipient. The controller then directs the address printer to print the address of the recipient on the bound book. The system described allows the creation of books in postal sorted order, wherein each book comprises a subset of signatures loaded into the packer boxes on the binding line where the subset is determined by the version code. This process of customization is called "selective binding."

In another system for producing customized books, a particular packer box on a binding line is loaded with pre-personalized signatures, which are signatures printed with content personalized for a particular recipient of a book. The pre-personalized signatures are loaded into a packer box in postal sorted order and include indicia such as a barcode or other optically readable marking representing a code associated with the recipient. Upon feeding of a pre-personalized signature from the particular packer box, a reader senses the indicia, identifies the code, and transmits the code to the controller. The controller uses the code to select recipient information from the mailing list. The recipient information may include an address of the recipient, a version code, and/or a device control code. If selective binding is used, then the controller uses the version code to determine the signatures that are to be included in the book for the recipient and selectively triggers the packer boxes that follow the packer box containing the pre-personalized signature accordingly. The controller directs the address printer to print the address of the recipient on the book. The system incorporates a single signature personalized for the recipient to be included in a book. It should be apparent that the controller can use version code to trigger only those packer boxes that follow the packer box that is loaded with the pre-personalized signature.

SUMMARY OF THE INVENTION

According to one aspect of the present application, a book production apparatus includes a gathering line and a plurality of feeding devices adapted to dispense at least one item onto the gathering line. The apparatus further includes a controller operatively connected to the plurality of feeding devices for controlling the operation thereof. The controller includes means for comparing first and second different customer data sources to generate instructions for the plurality of feeding devices and the first customer data source is associated with one of the plurality of feeding devices. The first customer data source is in the form of a customer list that is provided to the controller and the second customer data source is in the form of a mailing list such that information from the mailing list is compared with the first customer data source and the first customer data source is associated with one of the plurality of feeding devices.

Other aspects and advantages of the present application will become apparent upon consideration of the following detailed description and the attached drawings, in which like elements are assigned like reference numerals.

Other aspects and advantages of the present application will become apparent upon consideration of the following detailed description.

DETAILED DESCRIPTION

Figure 1:
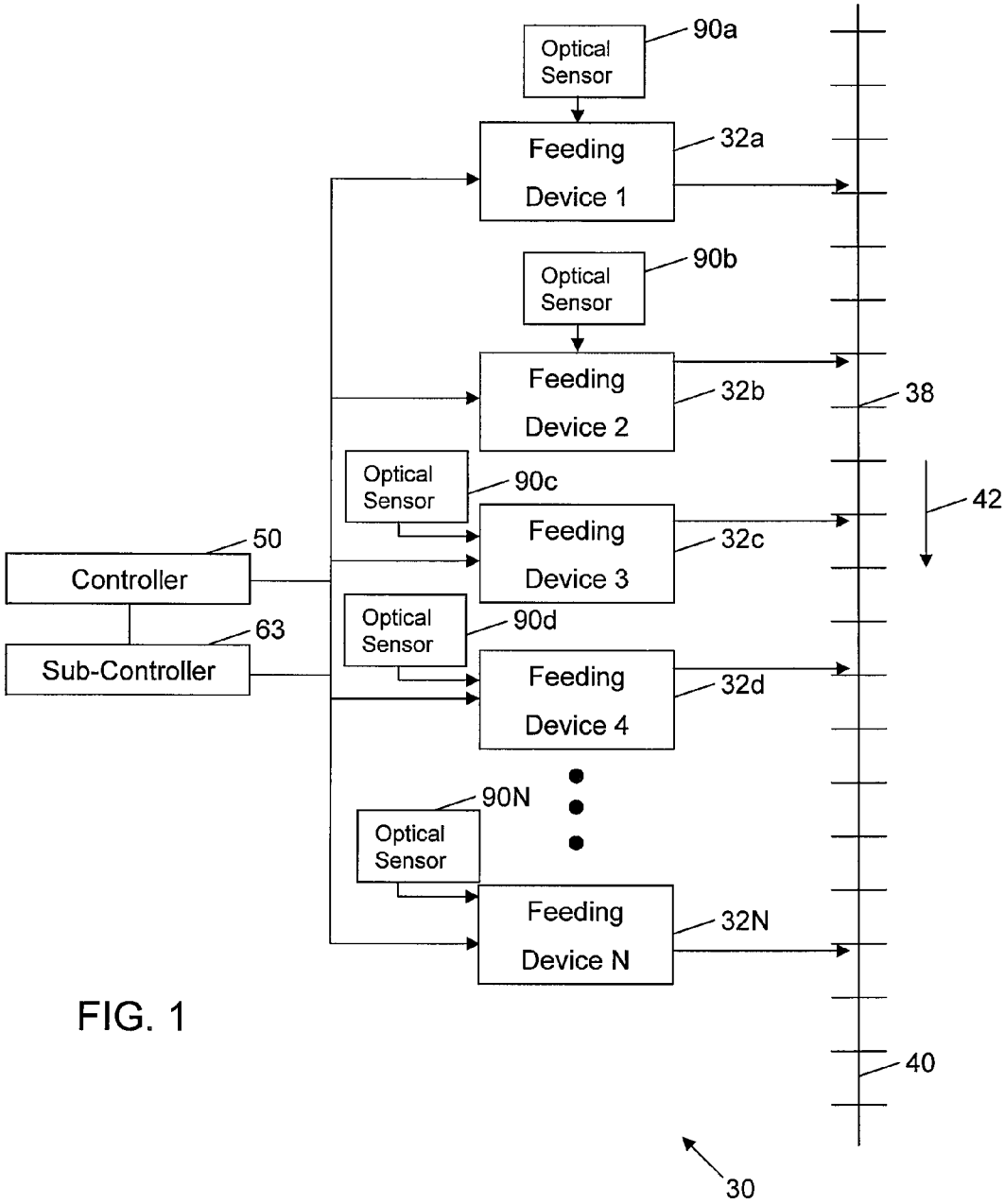
FIG. 1 is a block diagram illustrating a first embodiment of a book production apparatus.

Referring to the drawings, a first embodiment of a book production apparatus 30, as seen in FIG. 1, includes a plurality of feeding devices 32*a*, 32*b*, 32*c*, 32*d* . . . 32N each containing webs having printed material thereon. The webs are pre-printed, formed into folded signatures, cards, or other inserts, and placed into the respective feeding devices 32*a*, 32*b*, 32*c*, 32*d* . . . 32N before the book production apparatus 30 is initiated. Each feeding device 32*a*, 32*b*, 32*c*, 32*d* . . . 32N feeds the associated signature to a chain space 38 of a gathering line 40 of the type commonly employed in the art. The gathering line 40 includes a gathering chain or conveyor that is moveable past the feeding devices 32*a*, 32*b*, 32*c*, 32*d* . . . 32N. The gathering conveyor includes a plurality of chain spaces 38 separated from one another by pusher pins, wherein each chain space 38 is adapted to receive signatures from at least some of the feeding devices 32*a*, 32*b*, 32*c*, 32*d* . . . 32N in order as the chain spaces 38 travel in the direction noted by the arrow 42. The embodiments herein are disclosed in connection with a saddle stitch gathering device, as described in detail above. Other types of gathering devices may be employed in the present application, including but not limited to, flat or patent binding systems wherein signatures are loaded into a conveyor in a flat condition.

A controller 50 is operatively connected to and controls operation of the feeding devices 32*a*, 32*b*, 32*c*, 32*d* . . . 32N. In particular, any number of the feeding devices 32*a*, 32*b*, 32*c*, 32*d* . . . 32N may be operated to feed an associated signature to the chain space 38 of the gathering line 40 to make a specific book. One or more of the feeding devices 32*a*, 32*b*, 32*c*, 32*d* . . . 32N may also include pre-personalized signatures therein that have been personalized for a specific customer or recipient and placed in the particular feeding device 32*a*, 32*b*, 32*c*, 32*d* . . . 32N in a pre-sorted sequence. One or more of the feeding devices 32*a*, 32*b*, 32*c*, 32*d* . . . 32N may also include non-personalized signatures, wherein all of the signatures in a particular feeding device 32*a*, 32*b*, 32*c*, 32*d* . . . 32N are identical. The pre-personalized and non-personalized signatures are loaded into the respective feeding devices 32*a*, 32*b*, 32*c*, 32*d* . . . 32N prior to beginning operation of the book production apparatus 30. As the pre-personalized and non-personalized signatures are depleted, additional signatures are added to the respective feeding devices 32*a*, 32*b*, 32*c*, 32*d* . . . 32N generally in pre-sorted sequence. Optionally, more than one feeding device 32*a*-32N may be provided for a signature to account for large print jobs and reduce the number of times the feeding devices 32*a*-32N need to be replenished. The apparatus 30 and controller 50 could recover in the event that the preprinted pages are not in perfect sequence and corresponding mailing rates would be accounted for as a result of the modified ordering, or optionally the gathering line 40 could be automatically stopped if the order is determined to be significantly maligned to allow for a manual recovery.

Figure 2:
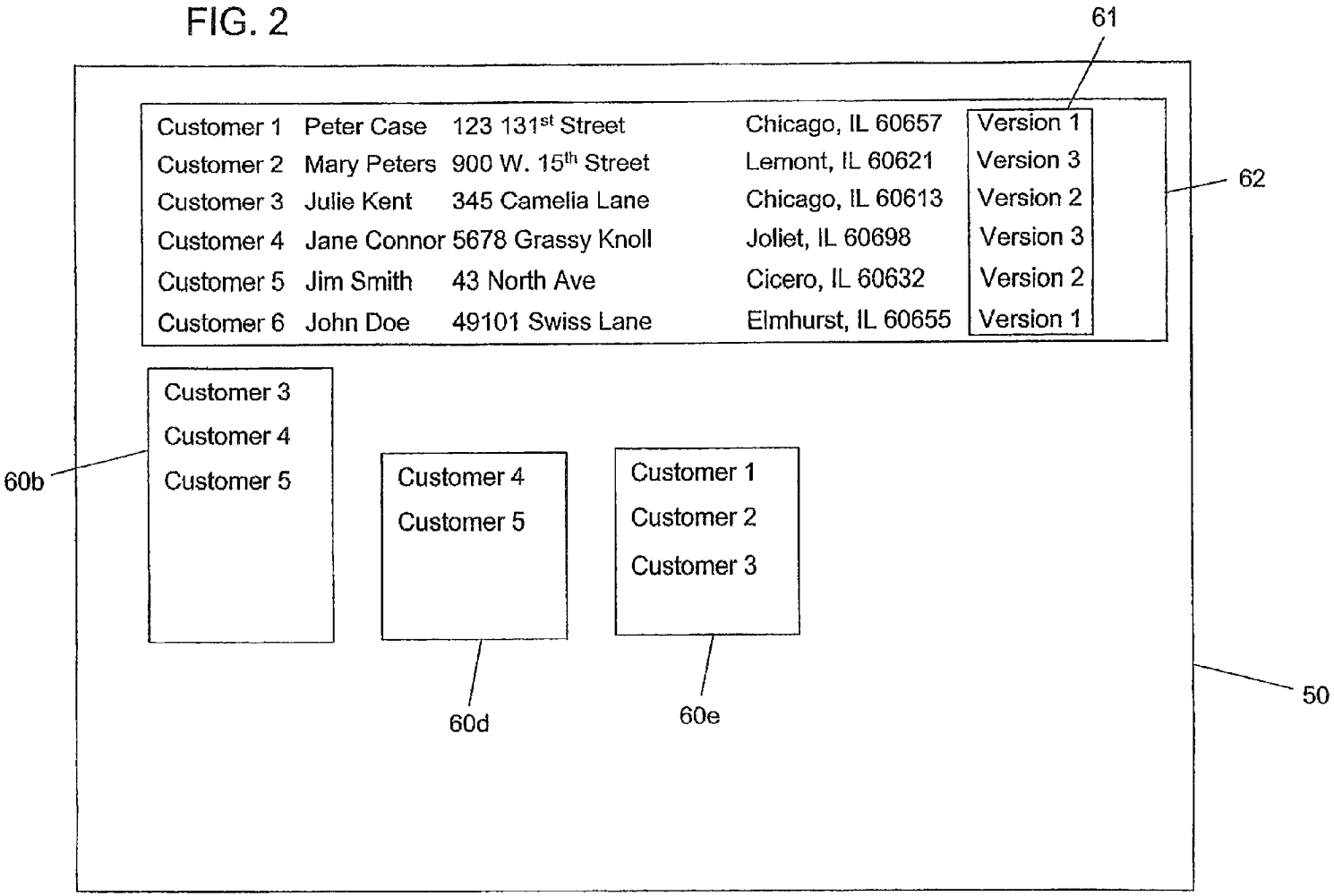
FIGS. 2 and 2A are block diagrams illustrating different embodiments of a controller within the book production apparatus of FIG. 1.
Figure 2A:
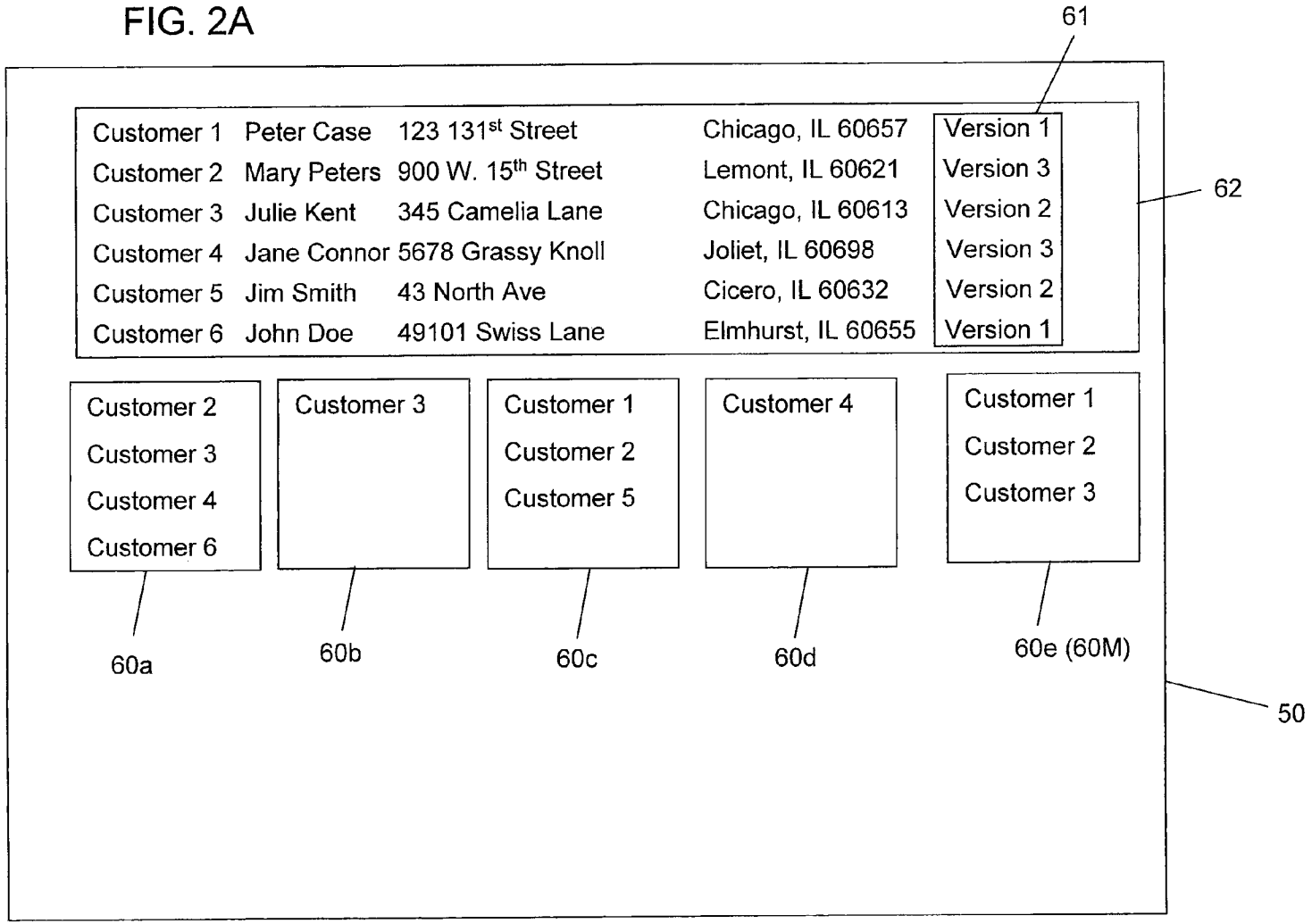

Referring to FIGS. 1 and 2, for each feeding devices 32*a*, 32*b*, 32*c*, 32*d* . . . 32N that contains at least one pre-personalized signature, a recipient list 60*a*, 60*b*, 60*c*, 60*d* . . . 60M associated with the pre-personalized signatures is provided to the controller 50, wherein M is a number less than or equal to N. For example, in the embodiment of FIG. 2, only feeding devices 32*b*, 32*d*, and 32*e* include recipient lists 60*b*, 60*d*, and 60*e* because only such feeding devices 32*b*, 32*d*, and 32*e* include pre-personalized signatures. In another embodiment wherein all feeding devices 32*a*, 32*b*, 32*c*, 32*d* . . . 32N include pre-personalized signatures, as seen in FIG. 2A, a separate recipient list 60*a*, 60*b*, 60*c*, 60*d* . . . 60M is provided to the controller 50 for each feeding device 32*a*, 32*b*, 32*c*, 32*d* . . . 32N. In either embodiment, the recipient list 60*a*, 60*b*, 60*c*, 60*d* . . . 60M indicates a sequence of recipients of the pre-personalized signatures for the particular feeding device 32*a*, 32*b*, 32*c*, 32*d* . . . 32M. A pre-sorted master mailing list 62 is also provided to the controller 50 with recipient information for each of the books that is to be printed, wherein the recipient information includes recipient name and address information, a version code 61 and the pre-personalized and non-personalized signatures expected for each recipient. A version code 61 is assigned to each recipient. The version code 61 indicates to the controller 50 the non-personalized signatures that are to be included in the book for a specific recipient. The indication of the pre-personalized and non-personalized signatures for each recipient in the master mailing list 62 provides a double check against the version code 61 and the recipient lists 60*a*, 60*b*, 60*c*, 60*d* . . . 60M to ensure the proper signatures are included for each recipient. In particular, the controller 50 checks the expected signatures against the actual signatures by reading a barcode or the like on the signatures, as discussed in detail hereinafter.

Although a single controller 50 is described herein, for complex systems, the controller 50 may include any number of subcontrollers 63 as seen in FIG. 1. In such a system, the controller 50 stores all or most information and communicates with the subcontrollers 63. For example, a subcontroller 63 may be utilized to read bar codes on signatures and transmit results to the controller 50, a subcontroller 63 may be utilized to send signals to the feeding devices 32*a*, 32*b*, 32*c*, 32*d* . . . 32M to direct same when to actuate, and/or a subcontroller 63 may be utilized to perform any of the functions of the controller 50 as described here. In any scenario, the controller 50 sends directions and necessary data to the subcontrollers 63 and the subcontrollers 63 return status information to the controller 50.

When the book production apparatus 30 is initialized, the controller 50 reads the master mailing list 62 to determine the first recipient. After creating a book for the first recipient, the apparatus 30 continues sequentially through the master mailing list 62 until a book is created for each recipient.

Each book is customized for a specific recipient, wherein for each recipient, the controller 50 reads the recipient lists 60*a*, 60*b*, 60*c*, 60*d* . . . 60M, the version code 61, and the master mailing list 62 and identifies a set of feeding devices 32*a*, 32*b*, 32*c*, 32*d* . . . 32N to trigger in accordance with the recipient lists 60*a*, 60*b*, 60*c*, 60*d* . . . 60M, the version code 61, and the master mailing list 62. The controller 50 also uses the respective recipient list 60*a*, 60*b*, 60*c*, 60*d* . . . 60M associated with each feeding device 32*a*, 32*b*, 32*c*, 32*d* . . . 32N that includes at least one pre-personalized signature to determine the recipient of the next pre-personalized signature therein. If the recipient of the next pre-personalized signature in a feeding device 32*a*, 32*b*, 32*c*, 32*d* . . . 32N matches the recipient of the book, the feeding device 32*a*, 32*b*, 32*c*, 32*d* . . . 32N containing the pre-personalized signature is added to the set of feeding devices 32*a*, 32*b*, 32*c*, 32*d* . . . 32N to be triggered. The controller 50 triggers all of the feeding devices 32*a*, 32*b*, 32*c*, 32*d* . . . 32N in the set in sequence to produce the book for the recipient in the manner described above.

The operation of the controller 50 will be explained in detail with reference to the example configuration of a controller 50 of FIG. 2 and the flow diagram of FIG. 3. Such example configuration is not meant to limit the present application in any way. The apparatus 30 includes a number N of feeding devices 32*a*, 32*b*, 32*c*, 32*d* . . . 32N and a number M of recipient lists 60*a*, 60*b*, 60*c*, 60*d* . . . 60M, wherein the number M is less than or equal to the number N. There are five feeding devices 32*a*-32*e* in this example, although any number of feeding devices 32*a*, 32*b*, 32*c*, 32*d* . . . 32N could be employed. In this example, the feeding devices 32*a* and 32*c* feed non-personalized signatures and the feeding devices 32*b*, 32*d*, and 32*e* feed pre-personalized signatures. The number of feeding devices 32*a*, 32*b*, 32*c*, 32*d* . . . 32N that feed pre-personalized and/or non-personalized signatures may be varied. Recipient lists 60*b*, 60*d*, 60*e* corresponding to feeding devices 32*b*, 32*d*, 32*e* are provided to the controller 50 and a master mailing list 62 including information and expected signatures for six recipients is also provided to the controller 50. The controller 50 is configured to produce three different versions of books, versions 1, 2, and 3. For version 1, non-personalized signatures are provided from the feeding devices 32*a*, 32*c*, for version 2, a non-personalized signature is provided from only the feeding device 32*c*, and for version 3, a non-personalized signature is provided from the feeding device 32*a*.

Figure 3:
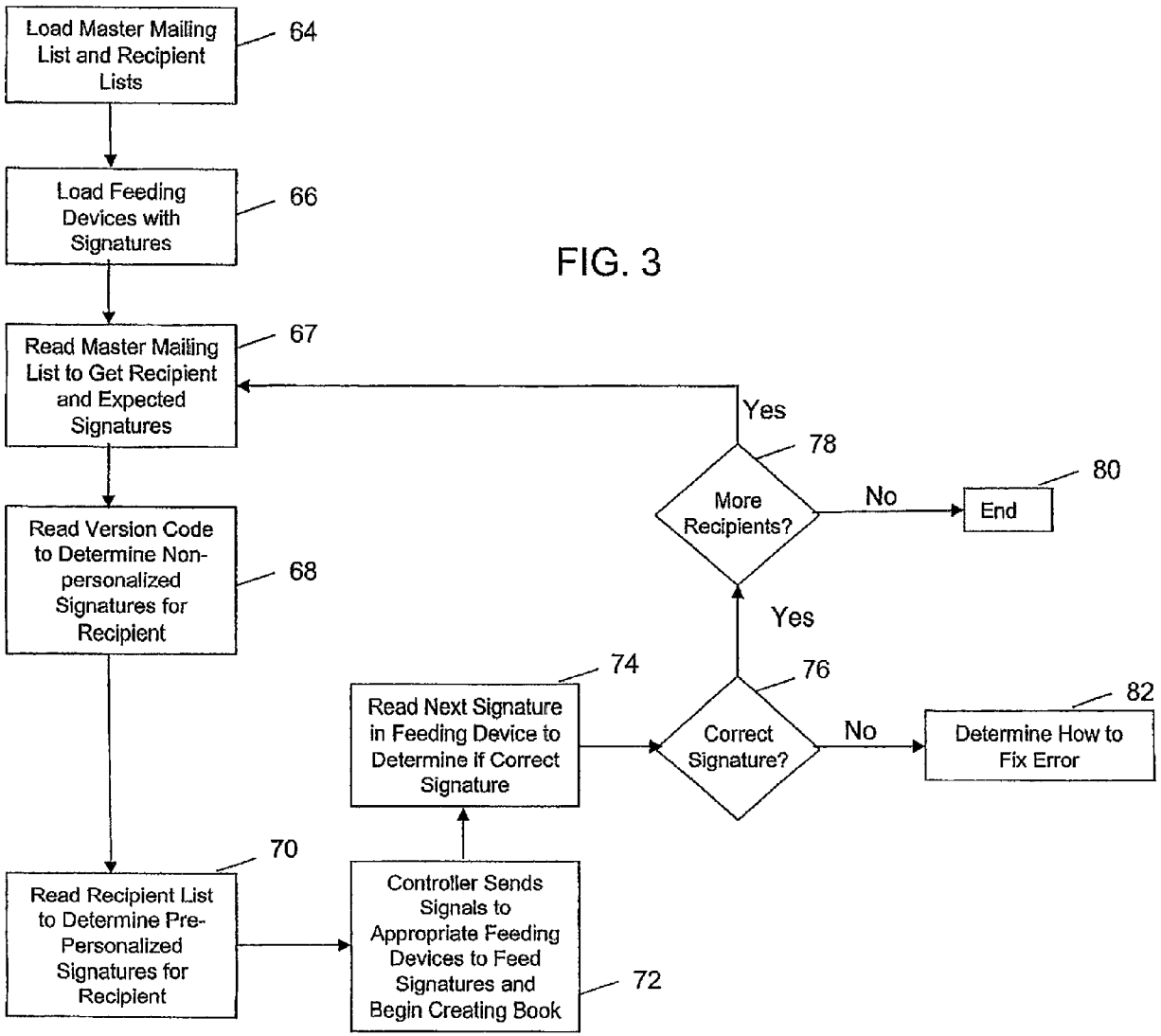
FIG. 3 is a flow diagram illustrating the operation of a controller within the book production apparatus of FIG. 1.

Still referring to the example configuration of FIG. 2 and the flow diagram of FIG. 3, before initialization of the book production apparatus 30, the master mailing list 62 and the recipient lists 60*b*, 60*d*, 60*e* are loaded into the controller 50 at block 64 of FIG. 3. Thereafter, all pre-personalized and non-personalized signatures are loaded into the feeding devices 32*a*-32*e* at block 66. Alternatively, the order of the steps performed in blocks 64 and 66 may be reversed. Upon initialization of the book production apparatus 30, the controller 50 reads the master mailing list 62 at block 67 to determine the first recipient and the expected signatures for that recipient. Thereafter, the controller 50 reads the version code 61 at block 68 for the particular recipient and reads the recipient lists 60*b*, 60*d*, 60*e* at block 70 to determine which non-personalized and personalized signatures, respectively, need to be fed to create a book for the first recipient. Optionally, the steps at blocks 68 and 70 may be reversed. In the example of FIG. 2, the first recipient is Customer 1 and the version code 61 corresponding to Customer 1 is version 1. In this case, the feeding devices 32*a*, 32*c* feed non-personalized signatures to the gathering line 40 for the book for Customer 1 corresponding to the version code 61 and the feeding device 32*e* feeds a personalized signature to the gathering line 40 corresponding to the recipient list 60*e*.

At block 72, the controller 50 sends signals to the appropriate feeding devices 32*a*, 32*c*, 32*e* to begin feeding signatures for creating a book for Customer 1. The signals for each feeding device 32*a*, 32*a*, 32*c*, 32*d* . . . 32N corresponding to a customer are spaced apart in time such that the corresponding signatures for a particular customer, such as Customer 1, land in the same chain space 38 of the gathering line 40 as that chain space 38 passes the feeding devices 32*a*, 32*b*, 32*c*, 32*d* . . . 32N that are to be actuated for the particular customer. Immediately after each feeding device 32*a*-32*e* feeds a signature or at the same time, block 74 directs optical sensors 90*a*-90*e* (FIG. 1), as discussed in greater detail below, at each feeding device 32*a*-32*e* to read an identification on the next signature for each feeding device 32*a*-32*e* to determine if the next signature is the appropriate signature for the next time the feeding device 32*a*-32*e* is to be actuated, which may be for the next book produced or for a later book to be produced. The identification can be in the form of a barcode or the like.

Reading of an identification may be asynchronous or synchronous. In particular, the identification in any apparatus 30 may be read just prior to triggering a feeding device 32*a*, 32*b*, 32*c*, 32*d* . . . 32N or just after the last signature was fed from a feeding device 32*a*, 32*b*, 32*c*, 32*d* . . . 32N, thereby exposing the next identification. Optionally, multiple signatures could be read in advance in a conveyor delivery system where signatures are shingled to expose the identifications of various signatures. Preferably, one or more subsequent signatures for each feeding device 32*a*, 32*b*, 32*c*, 32*d* . . . 32N are identified in each feeding device 32*a*, 32*b*, 32*c*, 32*d* . . . 32N at all times. In other words, depending on the design of the feeding devices 32*a*, 32*b*, 32*c*, 32*d* . . . 32N, multiple signatures could be in transit to the gathering line 40, thereby exposing the identification for signatures prior to the feeding of one or more signatures per feeding device 32*a*, 32*b*, 32*c*, 32*d* . . . 32N. The apparatus 30 and controller 50 may track the identifications for signatures in separate logical queues for each feeding device 32*a*, 32*b*, 32*c*, 32*d* . . . 32N, although this may also work without the look-ahead functionality just described. At any instant, the controller 50 knows in advance the recipient of the signature that is to be fed next for each feeding device 32*a*, 32*b*, 32*c*, 32*d* . . . 32N. In an alternative approach, the apparatus 30 and controller 50 could assume which feeding devices 32*a*, 32*b*, 32*c*, 32*d* . . . 32N are to be triggered for a particular recipient and then it confirms the signatures are correct when the signatures are fed. The reason there could be different approaches is: a) one or more identifications may not be accessible by the sensors 90*a*, 90*b*, 90*c*, 90*d* . . . 90N until the signature is placed in position in a book or in transit to the book (i.e., the identification(s) is located on a back side of the signature when in the feeding device 32*a*, 32*b*, 32*c*, 32*d* . . . 32N but the identification is exposed after the signature is fed); b) only one signature identification can be read prior to feeding (i.e., the front or top-most signature); or c) the signatures could be delivered in a shingled manner so that multiple signatures could be read in advance, enabling the system to "look-ahead" for inconsistencies.

Referring back to the example configuration of FIG. 2 and the flow diagram of FIG. 3, at block 76, the controller 50 determines whether there are any improper signatures and, if there are, the controller 50 proceeds to block 82 to fix the error. Optionally, if no errors are detected, the controller 50 proceeds to block 78 to determine whether there are remaining recipients for which books still need to be created. If there are more recipients, the controller 50 returns to block 67 and reads the master mailing list 62 to determine the second recipient and expected signatures after beginning production of the book for Customer 1. In the example of FIG. 2, the second recipient is Customer 2 and the version code 61 corresponding to Customer 2 is version 3. In this case, the feeding device 32*a* feeds a non-personalized signature to the gathering line 40 for the book for Customer 2 corresponding to the version code 61 and the feeding device 32*e* feeds a personalized signature to the gathering line 40 corresponding to the recipient list 60*e*. After beginning production of the book for Customer 2, the controller 50 again returns to block 67 and reads the master mailing list 62 to determine the next recipient and the expected signatures for that recipient. Customer 3 is the next recipient in the example of FIG. 2 and the version code 61 corresponding to Customer 3 is version 2. For Customer 3, the feeding device 32*c* feeds a non-personalized signature to the gathering line for the book for Customer 3 corresponding to the version code 61 and the feeding devices 32*b*, 32*e* feed personalized signatures to the gathering line 40 corresponding to the recipient lists 60*b*, 60*e*. The controller 50 continues creating books for all recipients in this manner until the controller 50 gets to block 78 and determines that there are no more recipients for which books still need to be created. In the example of FIG. 2, this would occur after the apparatus 30 begins creating a book for Customer 6 at block 72. At this point, the controller 50 proceeds to block 78, wherein the creation of addition books is halted because books have been created for all the recipients in the current master mailing list 62.

Figure 4:
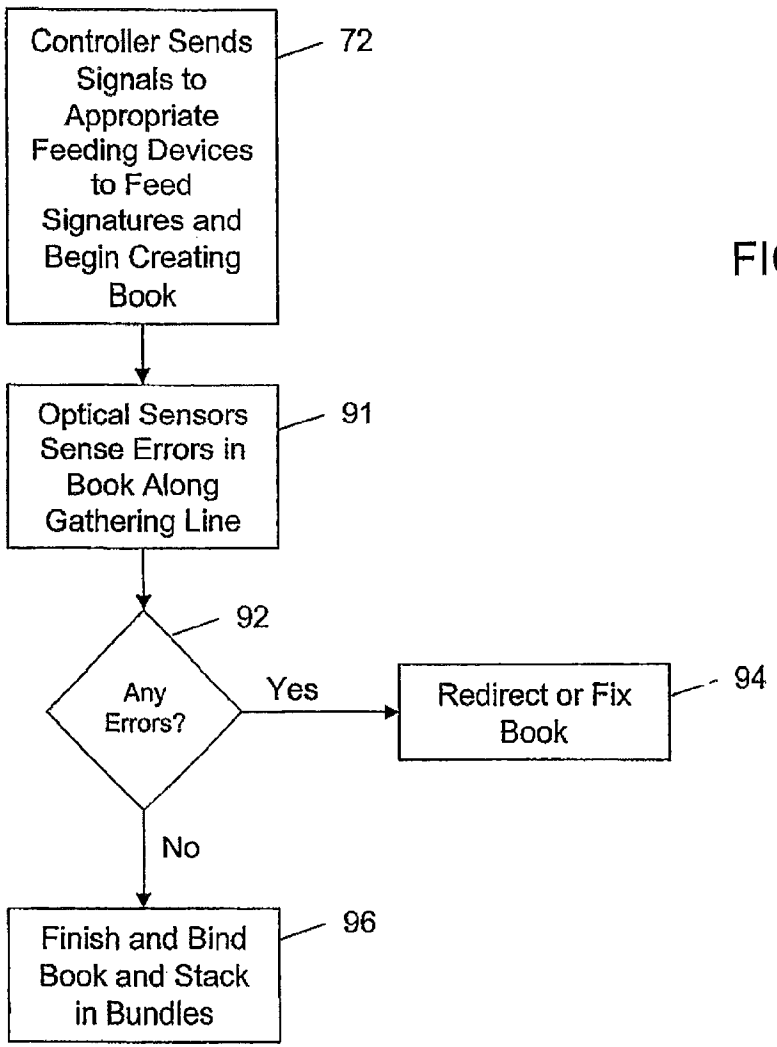
FIG. 4 is a flow diagram illustrating book production within the book production apparatus of FIG. 1.

Referring to the block diagram of FIG. 4, each time the controller 50 determines which feeding devices 32*a*, 32*b*, 32*c*, 32*d* . . . 32N to trigger for a particular book, the controller 50 sends signals to the appropriate feeding devices 32*a*, 32*b*, 32*c*, 32*d* . . . 32N to begin creating the book at block 72. As the appropriate feeding devices 32*a*, 32*b*, 32*c*, 32*d* . . . 32N feed signatures for a particular book, optical sensors 90*a*, 90*b*, 90*c*, 90*d* . . . 90N (FIG. 1), as discussed in detail below, at each feeding device 32*a*, 32*b*, 32*c*, 32*d* . . . 32N check, for example, a barcode on the signatures, to determine whether the appropriate signatures are to be added to the book at block 91. The controller 50 checks at block 92 to see whether the sensors 90*a*, 90*b*, 90*c*, 90*d* . . . 90N have sensed an error in the gathering line 40 or if sensors in the feeding devices 32*a*, 32*b*, 32*c*, 32*d* . . . 32N have sensed an incorrect signature. Some of the errors that could occur are a mis-feed, an out of order signature, or a missing signature. If an error has occurred, the controller 50 proceeds to block 94 to redirect or fix the error. If no errors have occurred, the controller 50 proceeds to block 96 and finishes and binds the book and stacks the books in appropriate bundles. Optionally, the signatures may be fed onto a conveyor such that as soon as the individual signatures are fed onto the conveyor, barcodes on the signatures are sensed. Preferably, the conveyor can hold several signatures so that any errors can be sensed before creation of a book(s) with the error(s) begins. In this manner, books with errors can be rejected and/or fixed earlier in the process to prevent unwanted downtime of the book production apparatus 30.

Preferably, the finished books are stacked appropriately into bundles to comply and maximize the value of the mail stream according to United States Postal Service regulations.

Referring again to FIG. 1, optical sensors 90*a*, 90*b*, 90*c*, 90*d* . . . 90N may be disposed above one or more of the feeding devices 32*a*, 32*b*, 32*c*, 32*d* . . . 32N to confirm that the recipient of the next pre-personalized signature in the respective feeding device 32*a*, 32*b*, 32*c*, 32*d* . . . 32N matches the recipient indicated by the recipient list associated with the feeding device 32*a*, 32*b*, 32*c*, 32*d* . . . 32N. The optical sensors 90*a*, 90*b*, 90*c*, 90*d* . . . 90N sense a bar code or the like on the signature and if the recipient name on the signature does not match that on the recipient list, the controller 50 may take corrective action, such as diverting the current book, not including the pre-personalized signature for the recipient in the current book, or alerting an operator of the book production apparatus 30. In addition, if there is a mis-feed in one or more of the feeding devices 32*a*, 32*b*, 32*c*, 32*d* . . . 32N, this is sensed and the book production apparatus 30 can recover from such a mis-feed by inserting a non-personalized signature in place of a mis-fed signature.

Numerous modifications to the present application will be apparent to those skilled in the art in view of the foregoing description. Accordingly, this description is to be construed as illustrative only and is presented for the purpose of enabling those skilled in the art to make and use the embodiments of the present application and to teach the best mode of carrying out same. The exclusive rights to all modifications which come within the scope of the appended claims are reserved.

I claim:

1. A book production apparatus comprising:

a gathering line;

a plurality of feeding devices adapted to dispense at least one item onto the gathering line; and a controller operatively connected to the plurality of feeding devices for controlling the operation thereof, wherein the controller comprises means for comparing first and second different customer data sources to generate instructions for the plurality of feeding devices, wherein the first customer data source is in the form of a customer list that is provided to the controller and the second customer data source is in the form of a mailing list such that information from the mailing list is compared with the first customer data source, and wherein the first customer data source is associated with one of the plurality of feeding devices.

2. The book production apparatus of claim 1, wherein the customer list includes recipient information for each of the books that is to be printed.

3. The book production apparatus of claim 2, wherein the recipient information includes a recipient name, address, version code, and items expected for each recipient.

4. The book production apparatus of claim 3, wherein the version code indicates to the controller the items that are to be included in the book for a specific recipient.

5. The book production apparatus of claim 3, wherein each feeding device contains at least one item and a recipient list.

6. The book production apparatus of claim 5, wherein each recipient list associated with a particular feeding device is also provided to the controller.

7. The book production apparatus of claim 6, wherein the controller compares the recipient list associated with each feeding device to the customer list.

8. The book production apparatus of claim 7, wherein the controller selectively triggers the feeding devices based on the comparison of the recipient lists and the customer list.

9. The book production apparatus of claim 8, wherein the controller uses the recipient list associated with each feeding device to determine the recipient of a next item therein.

10. The book production apparatus of claim 1, wherein the apparatus further includes optical sensors that read an identification on a next item for each feeding device to determine if the next item is an appropriate item.

* * * * *